United States Patent [19]

Sado

[11] 4,343,975

[45] Aug. 10, 1982

[54] KEY BOARD SWITCH UNIT WITH ILLUMINATION

[75] Inventor: Ryoichi Sado, Saitama, Japan

[73] Assignee: Shin-Etsu Polymer Co., Ltd., Tokyo, Japan

[21] Appl. No.: 211,781

[22] Filed: Dec. 1, 1980

[30] Foreign Application Priority Data

Dec. 7, 1979 [JP] Japan ..... 54-170217[U]

[51] Int. Cl.[3] ..... H01H 9/18

[52] U.S. Cl. ..... 200/314; 200/159 B; 200/310; 200/317; 362/31

[58] Field of Search ..... 200/159 B, 310, 311, 200/314, 317, 340, 5 A, 159 A, 159 B; 362/31

[56] References Cited

U.S. PATENT DOCUMENTS

| | | | |
|---|---|---|---|
| 2,886,911 | 5/1959 | Hardesty | 362/31 |
| 3,144,643 | 8/1964 | Andersson | 200/314 |
| 3,619,591 | 11/1971 | Korski | 200/314 |
| 4,022,993 | 5/1977 | Shattuck | 200/314 |
| 4,060,703 | 11/1977 | Everett | 200/310 |
| 4,163,883 | 8/1979 | Boulanger | 200/314 |
| 4,247,747 | 1/1981 | Swatten | 200/314 |
| 4,302,648 | 11/1981 | Sado et al. | 200/159 B |

*Primary Examiner*—John W. Shepperd

*Attorney, Agent, or Firm*—Hopgood, Calimafde, Kalil, Blaustein & Judlowe

[57] ABSTRACT

The invention provides a novel key board switch unit with illumination in the pushing areas, e.g. push buttons. Different from conventional ones, the pushing areas in the inventive unit are illuminated indirectly with the light emitted from a lamp positioned at a remote place not directly visible from above the pushing areas and, instead, an optical conductor member made of a transparent material is provided between the lamp and the pushing areas to be illuminated. The inventive key board switch unit can be very compactly designed despite the sufficiently high but not glaring intensity of illumination facilitating the operation of the switches even in a dark place.

6 Claims, 8 Drawing Figures

KEY BOARD SWITCH UNIT WITH ILLUMINATION

BACKGROUND OF THE INVENTION

The present invention relates to a novel key board switch unit with illumination suitable for use even in a dark place.

Many modern electronic appliances, e.g. electronic pocketable calculators and the like, are provided with a key board switch unit for operating the instrument. There are growing occasions of operating such a key board switch unit in a relatively dark place such as in automobiles at night so that many of the key board switch units are provided with a means for illumination.

The most simple method for illuminating a key board switch unit is the illumination of the board from above with a suitable lamp. Alternatively it is also conventionally practiced that the surface of the key top is coated with a phosphorescence or fluorescence material which emits visible light in a dark place to assist the recognition of the key board by the operator. Further, the pushing areas of the key top are made with a transparent or translucent material and illuminated with a suitable light source installed just below the pushing area of the key top.

The first method of illumination from above is the simplest in principle and sufficient lighting is readily obtained. This method is, however, impracticable when a very thin design of the key board switch unit is desired. In addition, complete shielding of stray light is sometimes very difficult in such a top illumination bringing about troubles such as glaringness when the key board switch unit is used in the room of an automobile or in a photographic dark room.

The second method of the use of a phosphorescent material is defective in the insufficient intensity of light emitted from the phosphorescent material so that it is not always suitable as an illuminating means of a key board switch unit.

The third method of the illumination from below the pushing areas of the key top also has a problem when a compact design of the unit is desired and uniform illumination of all of the pushing areas of the key top is obtained only with a considerable number of the light sources so that the method is not applicable when the electronic appliance having the key board switch unit is very thin as pocketable electronic calculators.

Thus, it has been an eager demand to develop a key board swtich unit with illumination free from the above described problems in the prior art and many attempts have been made therefor but without success.

SUMMARY OF THE INVENTION

It is therefore an object of the present invention to provide a key board switch unit with illumination having a very simple structure with a possibility of very compact design but, nevertheless, free from the above described disadvantages of the prior art, for example, of stray light, insufficient intensity of illumination and the necessity of a multiple number of light sources.

The key board switch unit with illumination of the present invention comprises.

(a) a base plate, (b) at least one fixed contact point provided on the surface of the base plate, (c) a switch panel member mounted on the base plate and having at least one pushing area for switching at the position above the fixed contact point on the base plate, at least a portion of the pushing area thereof being made of a transparent or translucent material, (d) at least one movable contact point provided on the lower surface of the switch panel member at the pushing area thereof, (e) at least one light source installed in a lamphouse between the base plate and the switch panel member at such a position that the light emitted therefrom is not directly visible from above through the transparent or translucent portion of the pushing area of the switch panel member, and (f) an optical conductor member made of a transparent material intervening between the light source and the pushing area of the switch panel member to conduct the light emitted from the light source to the pushing area, which optical conductor member may be a part of the switch panel member.

DETAILED DESCRIPTION OF THE PREFERRED EMBODIMENTS

The key board switch unit with illumination of the invention is now illustrated in detail with reference to the accompanying drawing.

Figure 1:
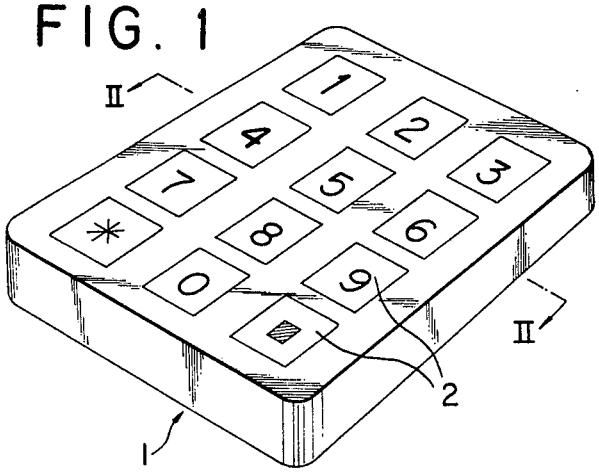
FIG. 1 is a perspective view of a typical key board switch unit of the invention.

FIG. 1 is a perspective view of a typical one of the inventive switch units which is frequently used in a dialing panel of telephones and the like instruments as constructed with a switch panel member 1 mounted on the base plate (not visible in this figure) and provided with twelve pushing areas 2,2 marked with numerals 1, 2, 3, . . . 9 and 0 and two figurative symbols.

Figure 2:
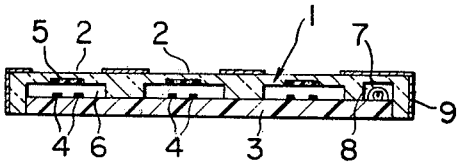
FIGS. 2 to 5 and FIG. 7 are each a cross sectional view of a different model of the inventive key board switch units.

FIG. 2 is a cross sectional view of the unit shown in FIG. 1 as cut and viewed along the line II—II. In this basic model of the unit, the switch panel member 1 is integrally shaped with a transparent material and mounted on the base plate 3. Pairs of fixed contact points 4,4 are provided on the surface of the base plate 3. The pushing areas 2,2 are positioned just above the respective pairs of the fixed contact points 4,4 and a movable contact point 5 is fixedly provided on the lower surface of the switch panel member 1 at the position just to face each of the pairs of the fixed contact points 4,4 to form a void space 6 between the fixed and movable contact points. When the switch panel member 1 is pushed at the pushing area 2 with a finger tip or the like, the switch panel member 1 is elastically deformed and depressed so as that the pair of the fixed contact points 4,4 is contacted with the movable contact point 5 to establish an electric connection between the fixed contact points 4,4. When the pushing force on the pushing area 2 is removed, the switch panel member 1 regains its undepressed state and the electric circuit between the fixed contact points 4,4 becomes opened.

Remotely from the pushing areas 2,2 of the switch panel member 1, a light source 7 is installed in the lamphouse 8 between the switch panel member 1 and the base plate 3. The position of this light source 7 should be such that the light emitted from the light source 7 is not visible directly from above the switch panel member 1 through the transparent or translucent portion of the pushing areas 2,2 so as that glaringness to the viewer's eyes can be avoided. It is also desirable that the lamp house 8 is partitioned from the void spaces 6 between the fixed contact points 4,4 and the movable contact points 5,5. This condition is important because otherwise the intensity of illumination on the individual pushing areas 2,2 is necessarily uneven.

The type of the light source 7 is not particularly limitative including miniature incandescent lamps, LED and the like provided that sufficiently strong light is emitted therefrom. The light emitted from the lamp 7 first enters the transparent switch panel member 1 which also serves as the optical conductor member and transmitted therethrough reaching the individual pushing areas 2,2 to illuminate the symbol marks provided on the pushing areas 2,2. It is preferable in the model shown in FIG. 2 that the portions of the outer surface of the switch panel member 1 outside and surrounding the pushing areas 2,2 are provided with a covering or coating layer 9 of an opaque material to shield the light from going out from such portions so that illumination is obtained only on the pushing areas 2,2 with improved outstanding distinguishability of the symbol marks on the pushing areas 2,2.

The transparent material for the switch panel member 1 is not particularly limitative but the transparency of the material is of course disirably as high as possible so as that the light reaching the furthest pushing area 2 may be illuminated with a sufficient intensity of light. It is also desirable that the transparent material has a refractive index as large as possible so as that good transmission of the light is obtained by the principle of total reflection. Elastic deformability is also essential in the model shown in FIG. 2 since the switching on and off of the switch unit entirely relies on the elastic resilience of the transparent material of the switch panel member 1. Several examples of the suitable transparent materials are, for example, polymethyl methacrylate, polystyrene, polyvinyl chloride and other plastics as well as certain kinds of rubbery elastomers such as silicone rubbers though not limited thereto.

It is preferable that the transparent switch panel member 1 is provided with a layer of a light-colored, e.g. white, pale yellow, pale blue, etc., material on the lower surface thereof at least in the pushing areas 2,2 so as that the luminosity of the pushing areas 2,2 is increased with consequent improvement in the distinguishability of the symbol marks thereon. For example, the switch panel member 1 in FIG. 2 is coated on the lower surface thereof with a white paint before the movable contact points 5 are adhesively bonded thereto so that the movable contact points 5, which are usually made of a black electroconductive rubber, are no longer visible from above through the transparent pushing areas 2,2.

It is also preferable that the upper surface of the switch panel member 1 is roughened or matted in the pushing areas 2,2 so as that the light emitted therefrom is irregularly scattered and the discernability of the pushing areas 2,2 is improved regardless of the viewing direction.

A variety of modifications are of course possible as developed from the basic model shown in FIG. 2. In the key board switch unit with illumination illustrated in FIG. 3 by the cross section, the switch panel member 1 made of a transparent material is bonded to the base plate 3 with spacers 10 intervening therebetween so that the lower surface of the switch panel member 1 may be flat excepting the portions to which the movable contact points 5 are bonded. Instead, the upper surface of the switch panel member 1 is raised or protruded in the pushing areas 2,2 in a form something like push buttons. The light-shielding covering member 9 is shaped in a frame-like form to fill the recessed areas surrounding the push-button like pushing areas 2,2 so that the upper surface of the switch unit as a whole is approximately flat.

Figure 3:
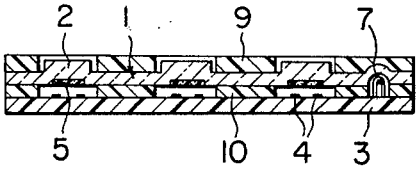

It should be noted in FIG. 3 that the lamp 7 in the lamphouse 8 is encircled by the walls of the lamphouse 8 in such a manner that the clearance space between the surface of the lamp 7 and the walls of the lamphouse 8 is minimum. This is a desirable condition in order to maximize the total dose of the light which the transparent switch panel member 1 receives from the lamp 7 through the walls of the lamphouse 8.

Figure 4:
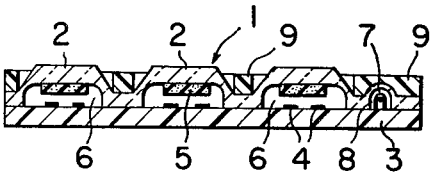

FIG. 4 illustrates a cross sectional view of a further modification of the key board switch unit with illumination of the invention, in which the switch panel member 1, which is mounted directly on the base plate 3 without spacers, made of a transparent material is raised something like a truncated cone or pyramid in the pushing areas 2,2 and the frame 9 is so constructed as to fill the grooves between the dome-like raised pushing areas 2,2. Otherwise the structure is the same as that shown in FIG. 2 including the disposition of the lamp 7 in the lamphouse 8 isolated from the switching spaces 6.

The common characteristic in the models illustrated in FIG. 2 to FIG. 4 is that the switch panel member 1 is shaped as a whole with a transparent material and serves also as the optical conductor member. This characteristic is of course not essential and the optical conductor member may be provided, if desired, separately from the parts pertaining to the switching action.

Figure 5:
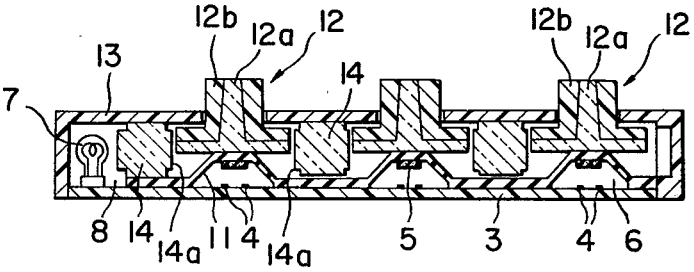

FIG. 5 illustrates an example of such a separate structure by the cross section. As is shown in the figure, a switch covering pad 11, which is made of a rubbery elastomer and is not necessarily transparent, is mounted on the base plate 3 provided with pairs of fixed contact points 4,4. The switch covering pad 11 is raised in several portions something like a truncated cone or pyramid just in the same manner as in the switch panel member 1 shown in FIG. 4 to form the switching spaces 6 between the pairs of the fixed contact points 4,4 on the base plate 3 and the movable contact points 5 bonded on the lower surface of the dome-like raised portions of the switch covering pad 11.

Instead of directly pushing the pushing areas of the switch covering pad 11, push buttons 12 are provided each on one of the dome-like raised pushing areas of the switch covering pad 11 so that switching operation is effected by pushing the top of the push button 12. The push button 12 itself is shaped, though not necessarily, with two kinds of materials to have a structure composed of a core and the bottom flat portion **12*a* made of a transparent material and the outer portion 12*b* made of an opaque material. The push buttons 12 are supported between the switch covering pad 11 and the upper board 13 as upwardly pushed up by the elastic resilience of the switch covering pad 11. The upper board 13** is made of an opaque material.

Figure 6:
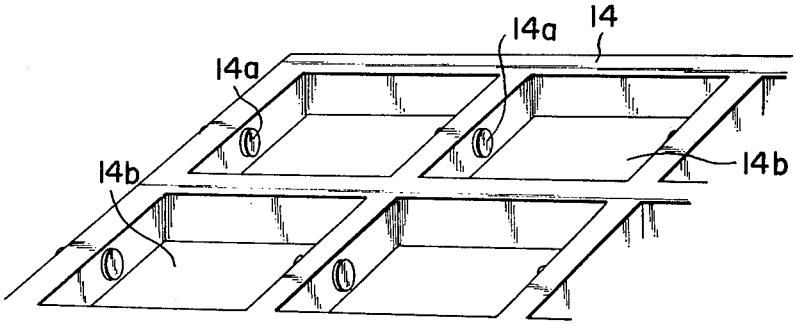
FIG. 6 is a perspective view of the optical conductor member used in the key board switch unit shown in FIG. 5 by the cross section.

Instead of having the switch covering pad 11 and/or the upper board 13 made of a transparent material to serve as the optical path conducting the light emitted from the lamp 7 in the lamphouse 8 to the transparent core portions 12*a* of the push buttons 12, an optical conductor member 14 made of a transparent material is installed between the lamphouse 8 and the push buttons 12. The optical conductor member 14 is shaped in a form of a frame something like a latticework as is shown in FIG. 6, each space 14*b* corresponding to the respective push button 12. It is preferable that the framework of the optical conductor member 14 is provided with several protrusions 14*a* in the form of something like studs or semispheres at the positions just facing the lamp 7 and the transparent core portions 12*a* of the push buttons 12 so as that the efficiencies to receive the light from the lamp 7 and to emit the light transmitted through the body of the optical conductor member 14 toward the push buttons 12 are increased.

Figure 7:
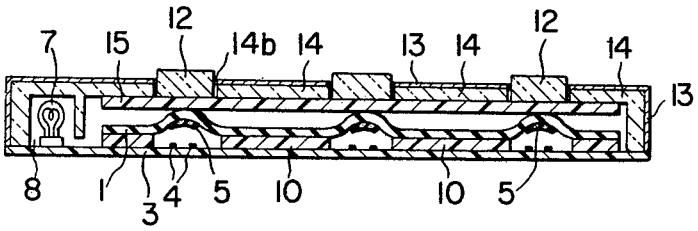

FIG. 7 illustrates another embodiment of the inventive key board switch unit with illumination having a separate optical conductor member by the cross section. In this figure, the disposition of the base plate 3, fixed contact points 4,4, the switch panel member 1 and the movable contact points 5 is not particularly different from that in FIG. 5 except that the switch panel member 1 is mounted on the base plate 3 with the spacers 10 therebetween. Instead of directly pushing the dome-wise raised portions of the switch panel member 1 with the push buttons 12, the push buttons 12 are bonded to a flexible sheet member 15 so that the pushing down of a push button 12 causes depression of the dome-wise raised portion of the switch panel member 1 through the downward elastic deformation of the flexible sheet member 15. Between the flexible sheet member 15 and the upper board 13, there is provided a flat optical conductor member 14 made of a transparent material and each of the push buttons 12, which are also made of a transparent material as a whole, fits one of the openings 14*b* in the optical conductor member 14 to be capable of sliding down and up in contact with the optical conductor member 14 so that transfer of the light emitted from the lamp 7 in the lamphouse 8 and transmitted through the optical conductor member 14 to the push button 12 is complete. The material of the flexible sheet member 15 may be either transparent or opaque while the upper board 13 is preferably opaque so as to better distinguish the illumination of the push buttons 12.

In designing the key board switch units with illumination according to the invention, the optical performance of the material for shaping the optical conductor member 14 is of essential importance. As is mentioned before, it is a desirable condition that the refractive index of the transparent material be as large as possible in order to minimize straying out of the light through the surface of the optical conductor member 14. In this sense, it is preferable that the surface of the member 14 is plated with a highly reflective metal such as aluminum or silver excepting the areas for light receiving from the lamp 7 and for light emission to the pushing areas to be illuminated.

Apart from the above mentioned parameters which may contribute to the improvement of the light transmission through the optical conductor member, the inventor has discovered that a perfect transparency of the material not always gives the best results from the standpoint of obtaining overall effects of improving the distinguishability of the pushing areas as illuminated. This is presumably because the light transmitted through a perfectly transparent switch panel member can hardly be emitted from the pushing areas but merely passes by through the transparent body so that the overall illuminating effect in the pushing areas is reduced.

In this connection, a material in which slight light scattering takes place is rather preferable if the transparency of the material is not unduly decreased. An example of such preferred materials is a silicone rubber filled with a silica filler such as fumed silica, percipitated silica, diatomaceous earth and the like which retains sufficient transparency by virtue of the remarkable affinity between the organopolysiloxane matrix and the silica surface and exhibits moderate light scattering.

Figure 8:
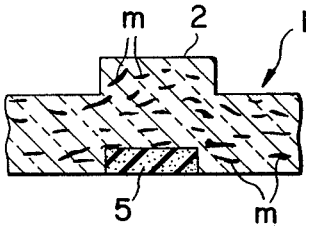
FIG. 8 is a schematic illustration of the transparent material for the optical conductor member in which a large number of reflective flakes are dispersed in the transparent matrix.

In seeking a more satisfactory material for the optical conductor member, the inventor has arrived at an unexpected discovery that very satisfactory results are obtained with a transparent plastic or rubbery material in which comminuted flakes with highly reflective surfaces, e.g. foils of aluminum, silver and the like, are dispersed as oriented with their surfaces substantially in parallel with the direction of the light transmission through the optical conductor member. FIG. 8 illustrates an enlarged partial cross section of a switch panel member 1 as shown in FIG. 3 made of such a material with foil dispersion. A large number of tiny flakes m of a metal foil or other equivalent material are dispersed in the transparent matrix of the switch panel member 1 as oriented so as that the surfaces of the flakes m are substantially in parallel with the surface of the switch panel member 1 and the efficiency of light transmission along the surface of the member is improved by virtue of the multiple reflection on the surfaces of the flakes m to minimize irregular scattering and straying out. In the portions where the surface of the switch panel member 1 is not flat as in the pushing area 2 shown in the figure, it is desirable that the orientation of the reflective flakes m is in the desired direction of light conduction. In the pushing area 2 shown in FIG. 8, for example, the flakes m should be oriented as upwardly deflected along the surface of the protrusion so as that the light transmitted through the body of the switch panel member 1 is most efficiently emitted from the upper surface of the pushing area 2 with increased effect of illumination.

What is claimed is:

1. A key board switch unit with illumination which comprises:

(a) a base plate, (b) at least one fixed contact provided on the surface of the base plate, (c) a switch panel member mounted on the base plate and having at least one pushing area carrying at least one moveable contact positioned above the fixed contact point on the base plate for engagement with said fixed contact, at least a portion of the pushing area thereof being made of a transparent or translucent material, (d) at least one light source installed in a lamphouse between the base plate and the switch panel member at such a position that the light emitted therefrom is not directly visible from above through the transparent or translucent portion of the pushing area of the switch panel member, and (e) wherein said switch panel is an optical conductor constructed of a transparent or translucent material to conduct the light emitted from the light source to the pushing area.

2. The key board switch unit with illumination as claimed in claim 1 wherein the upper surface of the portion of the pushing area of the switch panel member made of a transparent or translucent material is roughened or matted so as that the light emitted therefrom is irregularly scattered.

3. The key board switch unit with illumination as claimed in claim 1 wherein the switch panel member is provided on the lower surface thereof with a layer of a light-colored material at least in the pushing area.

4. The key board switch unit with illumination as claimed in claim 1 wherein the optical conductor member is made of a transparent material in which a large number of comminuted metal flakes are dispersed as oriented with the surfaces thereof substantially in parallel with the direction of light conduction.

5. The key board switch unit with illumination as claimed in claim 1 wherein the light source is installed in the lamphouse in such a manner as encircled by the walls of the lamphouse with a minimum clearance space therebetween.

6. The key board switch unit with illumination as claimed in claim 1 wherein the transparent material comprising the optical conductor member is a silicone rubber filled with a silica filler.

* * * * *